US011952897B1

(12) United States Patent
Collins et al.

(10) Patent No.: US 11,952,897 B1
(45) Date of Patent: Apr. 9, 2024

(54) SYSTEM FOR REMOTELY OPERATING A MINE MACHINE AND RELATED METHODS

(71) Applicant: J.H. FLETCHER & CO., Huntington, WV (US)

(72) Inventors: Craig Matthew Collins, Proctorville, OH (US); Billy Davis Goad, Jr., Salt Rock, WV (US); Robert William Thomas, Jr., St. Petersburg, FL (US)

(73) Assignee: J.H. FLETCHER & CO., Huntington, WV (US)

( * ) Notice: Subject to any disclaimer, the term of this patent is extended or adjusted under 35 U.S.C. 154(b) by 1668 days.

(21) Appl. No.: 15/595,386

(22) Filed: May 15, 2017

Related U.S. Application Data

(60) Provisional application No. 62/336,192, filed on May 13, 2016.

(51) Int. Cl.
*E21C 35/24* (2006.01)
*E21C 35/04* (2006.01)
(Continued)

(52) U.S. Cl.
CPC ..... *E21C 35/24* (2013.01); *E21C 35/04* (2013.01); *E21D 9/108* (2013.01); *E21C 35/00* (2013.01)

(58) Field of Classification Search
CPC ..... E21C 35/04; E21C 35/08; E21C 35/24; E21C 35/00; E21D 9/108; E21D 9/1093; E21D 9/1013; E21D 9/102; E21D 9/1026; G05B 2219/40197; G05B 2219/40203; G05B 2219/40317; G05B 2219/40339; G05B 2219/39082; G05B 2219/39088;
(Continued)

(56) References Cited

U.S. PATENT DOCUMENTS 5,253,925 A * 10/1993 Modzik, Jr. ..... E21C 35/223 299/12
7,721,816 B1 5/2010 Wilson et al.
(Continued)

FOREIGN PATENT DOCUMENTS

DE 3991599 T1 * 2/1991 ..... E21C 35/24
DE 202015101170 5/2015
(Continued)

OTHER PUBLICATIONS

English language machine translation of Kononov et al., DE-3991599-T1, published Feb. 21, 1991 (Year: 1991).*
(Continued)

*Primary Examiner* — Abby J Flynn
*Assistant Examiner* — Michael A Goodwin
(74) *Attorney, Agent, or Firm* — Dickinson Wright PLLC; Andrew D. Dorisio

(57) ABSTRACT

A system for remotely operating a machine, such as a mine vehicle, includes at least one first emitter for emitting a first signal corresponding to a first zone adjacent to the machine. A transmitter is provided for receiving the first signal emitted by the emitter, the transmitter being adapted for issuing commands for controlling the machine and also indicating the presence of the transmitter in the first zone. A controller is also provided for controlling the machine based on the control signals from the transmitter based on the presence of the transmitter in the first zone. Related methods are also disclosed.

14 Claims, 13 Drawing Sheets

(51) Int. Cl.
*E21D 9/10* (2006.01)
*E21C 35/00* (2006.01)

(58) Field of Classification Search
CPC ..... G05B 2219/39099; G05B 2219/39091; G05B 2219/40478; G05B 2219/40475; G05B 2219/40202; B25J 9/1666; B25J 9/1674; B25J 9/1676
USPC ..... 701/50
See application file for complete search history.

(56) References Cited

U.S. PATENT DOCUMENTS 9,169,973 B2 10/2015 Nickel
2006/0087443 A1* 4/2006 Frederick ..... E21C 35/24 340/686.6
2006/0271263 A1* 11/2006 Self ..... G01S 3/143 701/50
2010/0221071 A1 9/2010 Hinshaw et al.
2010/0271214 A1* 10/2010 Frederick ..... F16P 3/147 340/600
2011/0260847 A1* 10/2011 Leppanen ..... B66C 15/06 340/435
2012/0025964 A1* 2/2012 Beggs ..... G08B 21/18 340/435
2014/0266759 A1* 9/2014 Pryor ..... E02F 3/16 340/686.6
2014/0369334 A1* 12/2014 Bertosh ..... F16P 3/145 370/338
2015/0061880 A1* 3/2015 Rosenstern ..... E21C 35/04 340/686.6

FOREIGN PATENT DOCUMENTS

EP 1482238 1/2004
EP 1479964 A2 * 11/2004 ..... B25J 19/06
EP 3112900 4/2017

OTHER PUBLICATIONS

Bissert, P.T., Carr, J.L. & Ducarme, J.P., Proximity detection zones: Designs to prevent fatalities around continuous mining machines. Professional Safety 2016, 61(6), 72-77. https://www.ncbi.nlm.nih.gov/pmc/articles/PMC4982554/.
Yang, L. & Noguchi, N., Human detection for a robot tractor using omni-directional stereo vision. Computers and Electronics in Agriculture, 89, 116-125, (2012).
Leger P.C. et al., Obstacle detection and safeguarding for a high-speed autonomous hydraulic excavator. Proc. SPIE 3525, Mobile Robots XIII and Intelligent Transportation Systems, 146 (1999).

* cited by examiner

Zone #1 Active

Zone #1 Active

Zone #1 Active

Boom is Swung Left

Boom is Centered

Boom is Swung Right

SYSTEM FOR REMOTELY OPERATING A MINE MACHINE AND RELATED METHODS

This patent application claims the benefit of U.S. Provisional Patent Application Ser. No. 62/336,192, filed May 13, 2016, the disclosure of which is incorporated herein by reference.

TECHNICAL FIELD

This disclosure relates to the mining arts and, more particularly, to a system for remotely operating a mine machine, such as a vehicle, and related methods.

BACKGROUND

During mining, and particularly in underground locations, machines in the form of vehicles are typically used for performing a number of functions, including drilling, installing roof bolts, transporting or hauling materials and people, and also sometimes for scaling the mine walls to win material therefrom. Sometimes, an individual or operator may be present at locations adjacent to the machine or the vehicle, which could place them in the way of unintended movements.

In the past, others have proposed systems for detecting the presence of an individual relative to a vehicle (such as for example U.S. Patent Application Publication No. 2010/0221071, the disclosure of which is incorporated by reference). This and other systems like it have typically focused on disabling the operation of the machine entirely upon detecting the presence of an individual at a particular location.

This disclosure proposes a system whereby a machine or vehicle may still be used for certain operations while ensuring that it is not used in a manner that would interfere with a person at a particular location relative to the machine or vehicle. The system would provide reliable operation and would be easy to install on any machine, including even in a retrofit situation.

SUMMARY

According to one aspect of the disclosure, a system for remotely operating a machine is provided. The system may comprises at least one first emitter for emitting a first signal corresponding to a first zone adjacent to the machine. A transmitter is provided for receiving the first signal emitted by the emitter, the transmitter being adapted for issuing commands for controlling the machine and also indicating the presence of the transmitter in the first zone. A controller is also provided for controlling the machine based on the control signals from the transmitter based on the presence of the transmitter in the first zone.

In one embodiment, the controller is adapted for preventing any part of the machine from moving to the first zone when the transmitter is indicated therein. A second emitter may also be provided for emitting a second signal corresponding to a second zone adjacent to the machine. The controller may be further adapted for controlling the machine based on the control signals from the transmitter based on the presence of the transmitter in the first zone.

A receiver may be provided for receiving the commands from the transmitter and providing the commands to the controller. An indicator may also be provided for indicating the presence of the transmitter in the first zone. The transmitter may include one or more inputs for controlling the machine. The transmitter may comprise a hand-held, portable unit. The controller may be adapted for allowing the machine to operate in any zone other than the first zone. The emitter may comprises an infrared emitter for emitting a signal indicative of the first zone.

According to a further aspect of the disclosure, a system comprises a vehicle and at least one first emitter for emitting a first signal corresponding to a first zone adjacent to the vehicle. The system may further include a transmitter for receiving the first signal emitted by the emitter. The transmitter may be adapted for issuing commands for controlling the vehicle and also indicating the presence of the transmitter in the first zone. A controller is provided for controlling the vehicle based on the control signals from the transmitter based on the presence of the transmitter in the first zone.

In one embodiment, the vehicle is selected from the group consisting of a scaler, a bolter, a hauler, a scoop, a lifter, a jumbo drill, or any combination thereof. The vehicle may include a boom adapted for moving to the first zone, and the controller is adapted for preventing the boom from moving to the first zone when the transmitter is present therein. In such case where the vehicle includes a boom, the controller may be adapted for enabling the operation of the boom when the transmitter is present in the first zone.

A plurality of zones may be defined adjacent to the vehicle, and an emitter is associated with each zone. The or each emitter may be attached to the vehicle at a location corresponding to the associated zone. The vehicle may also include controls for controlling the operation of the vehicle, and the transmitter is adapted for controlling the vehicle at a location remote from the controls.

Still a further aspect of the disclosure pertains to a method of controlling a machine. The method comprises detecting the presence of a transmitter for transmitting commands to the machine in a particular zone relative to the machine and enabling the machine to operate in a predetermined manner based on the detected presence of the transmitter in the particular zone.

The enabling step may comprise preventing the machine from moving to the particular zone when the transmitter is present therein. The enabling step may comprise allowing the machine to move within a different zone when the transmitter is present in the particular zone. The enabling step may comprise enabling a part of the machine to move.

The method may further include the step of emitting a signal from the machine indicative of the particular zone. Still further, the method may include the step of controlling the machine using controls onboard the machine or controls associated with the transmitter.

Yet another aspect of the disclosure pertains to a method of operating a machine. The method comprises defining a first zone adjacent to the machine, defining a second zone adjacent to the machine, controlling the machine according to a first control protocol based on the presence of an operator at the first zone, and controlling the machine according to a second control protocol based on the presence of the operator at the second zone.

Another aspect of the disclosure pertains to a method of operating a machine. The method comprises defining a first zone adjacent to the machine, defining a second zone adjacent to the machine, controlling the machine according to a first control protocol based on the presence of an object at the first zone, and controlling the machine according to a second control protocol based on the presence of the object at the second zone. The object may comprise a transmitter for transmitting control signals for controlling the machine.

BRIEF DESCRIPTION OF THE DRAWING FIGURES

The accompanying drawing figures incorporated herein and forming a part of the specification, illustrate several aspects of the inventions and together with the description serve to explain certain principles thereof. In the drawing figures.

Figure 9:
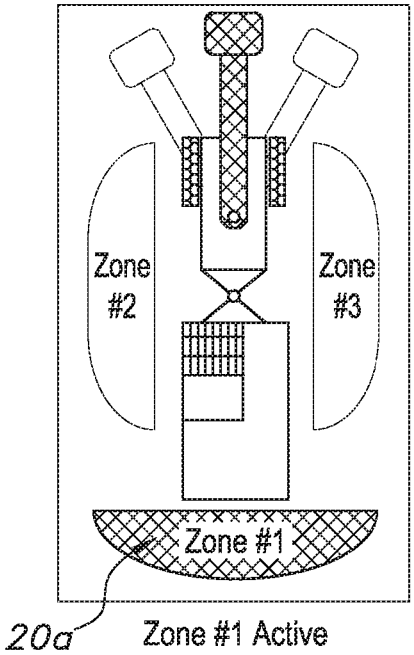
Figure 9A:
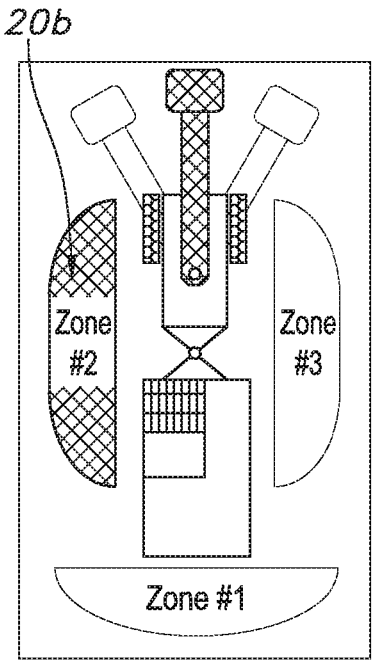
Figure 9B:
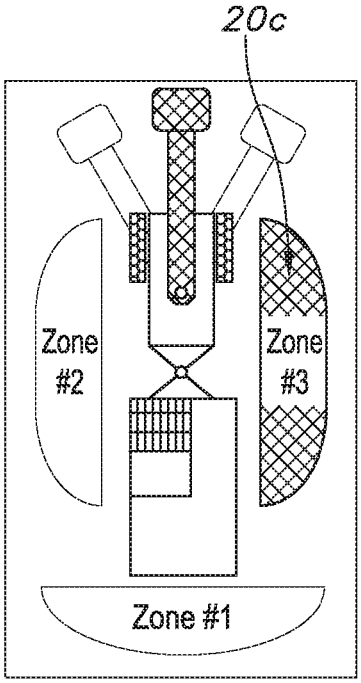
Figure 10:
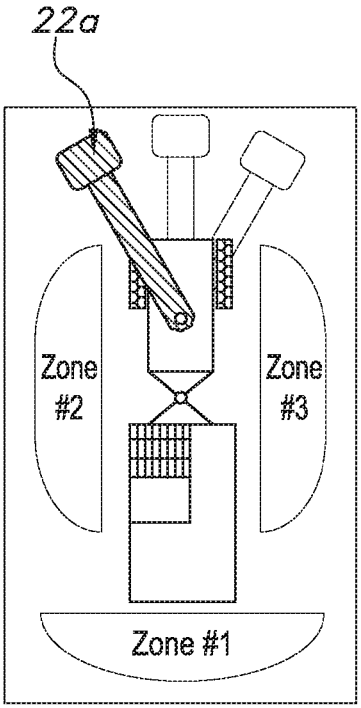
Figure 10A:
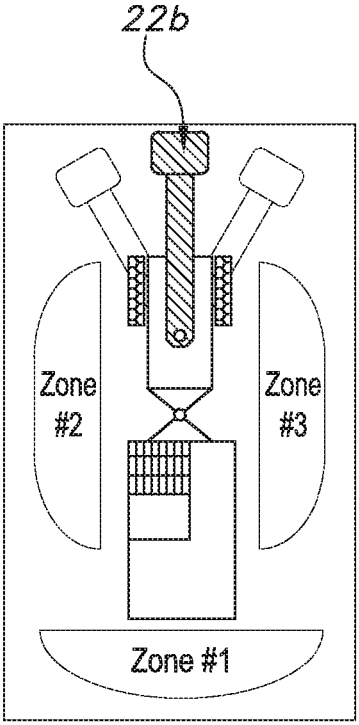
Figure 10B:
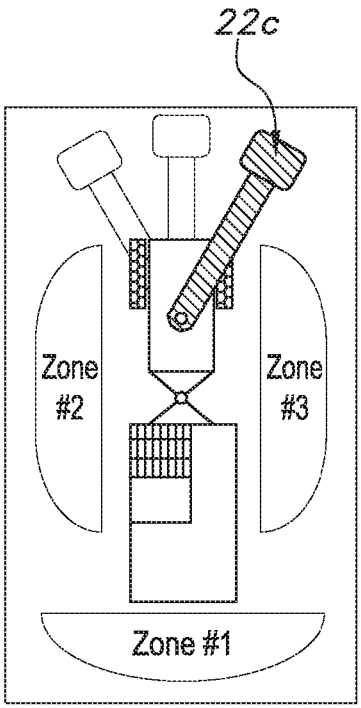
Figure 11:
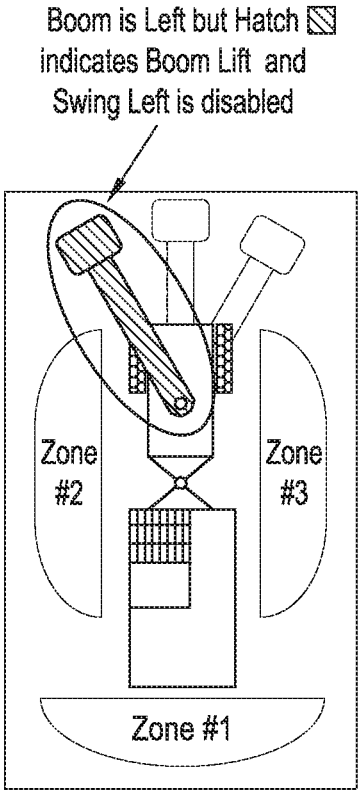
Figure 11A:
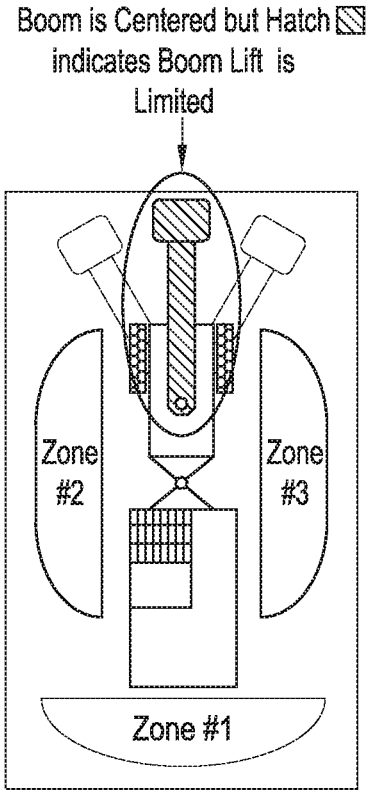
Figure 11B:
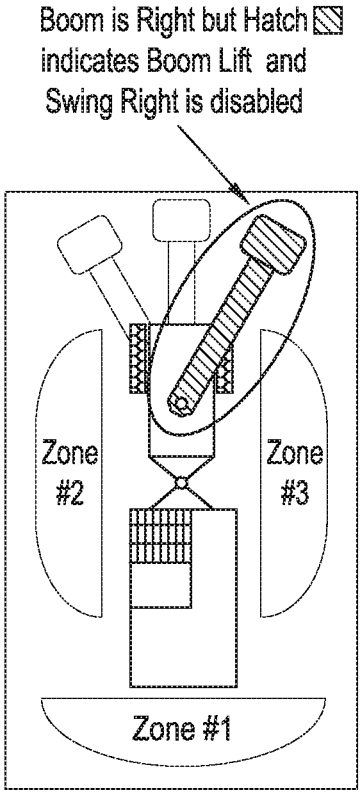
Figure 12:
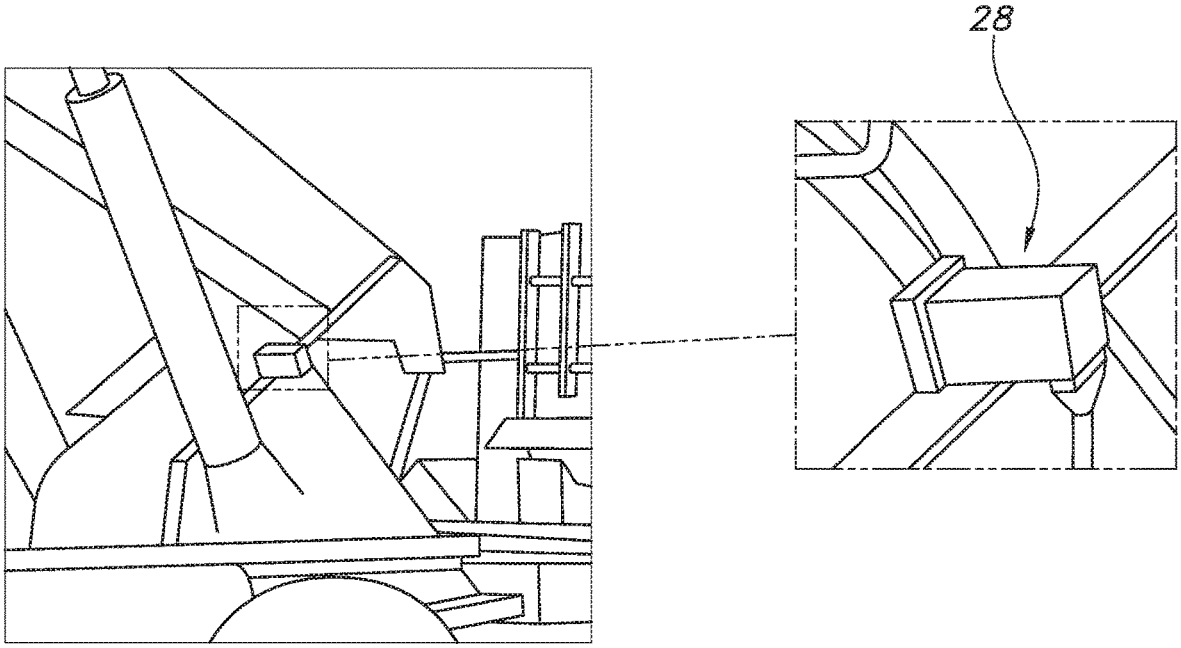
Figures 13, 13A, 13B:
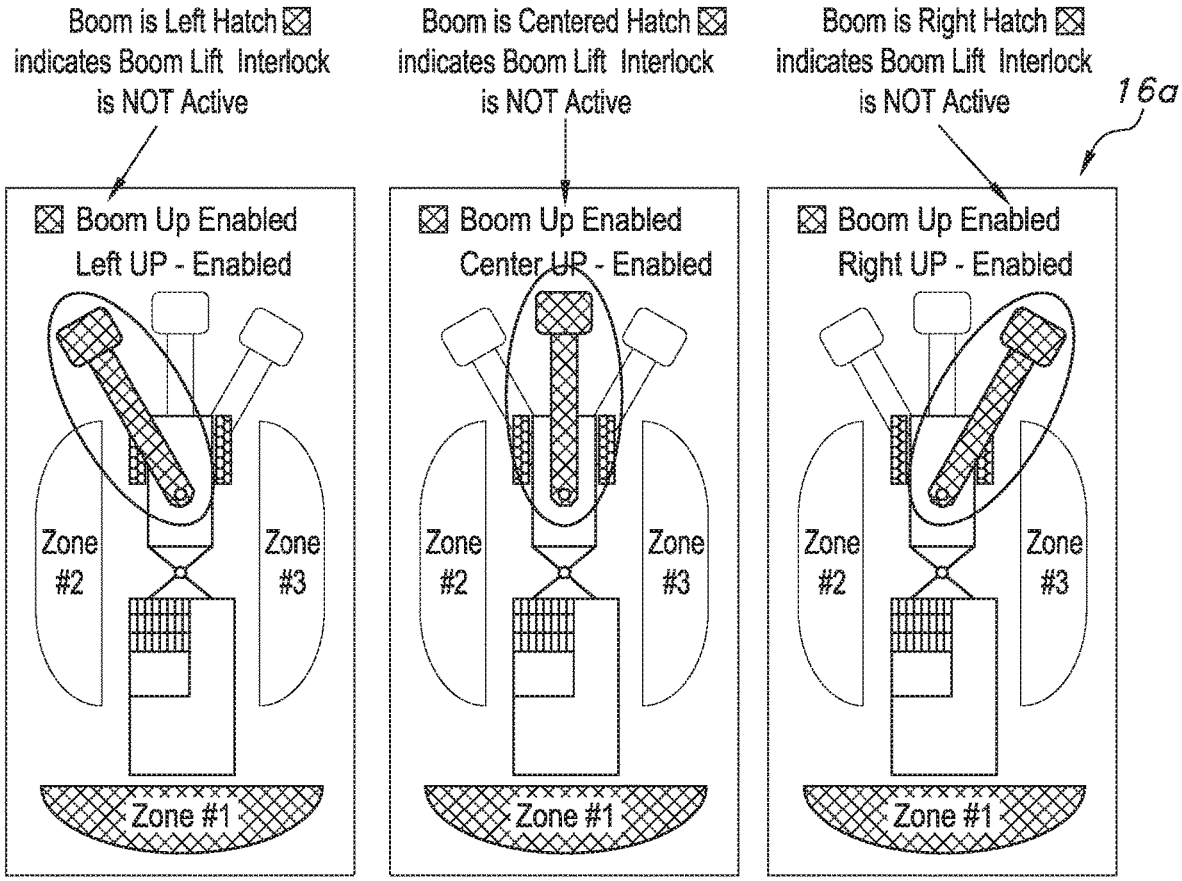
Figure 14:
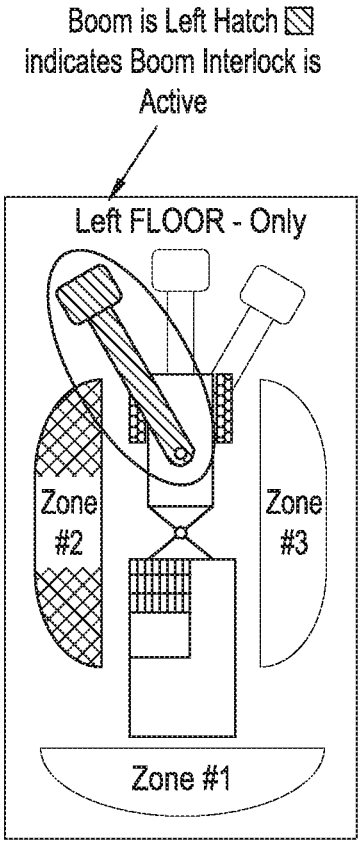
Figure 14A:
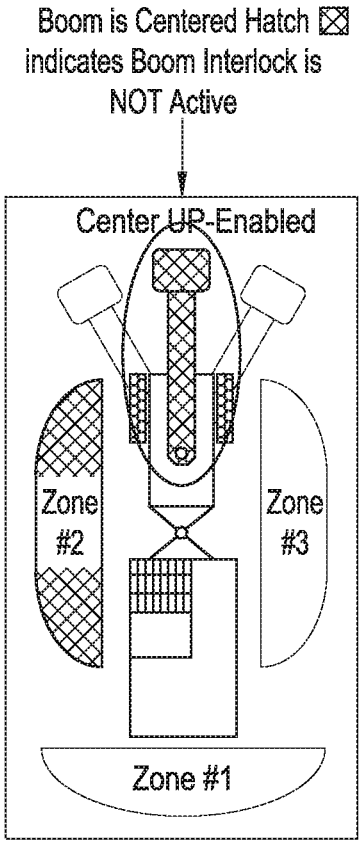
Figure 14B:
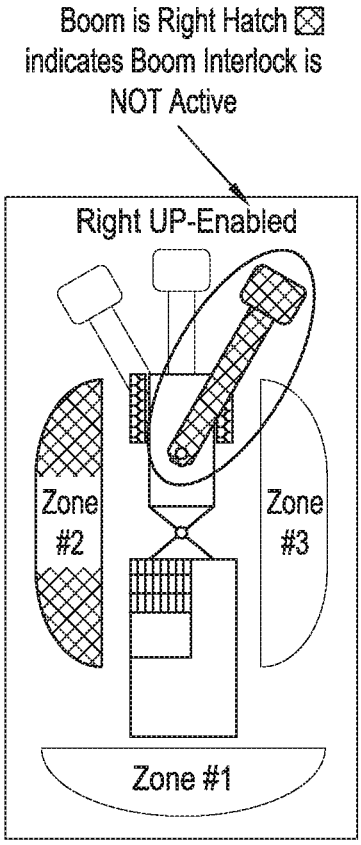
Figure 15:
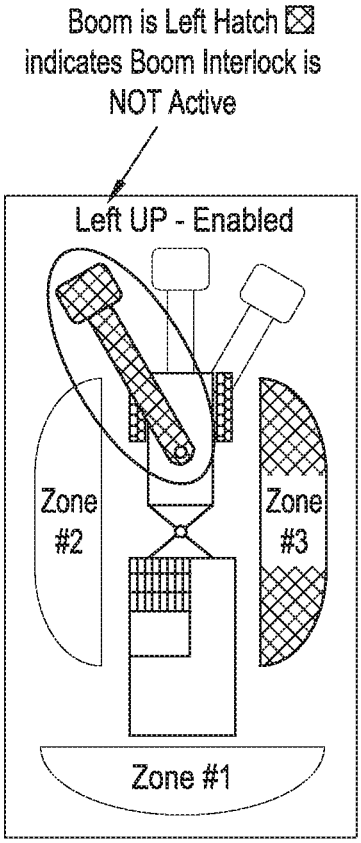
Figure 15A:
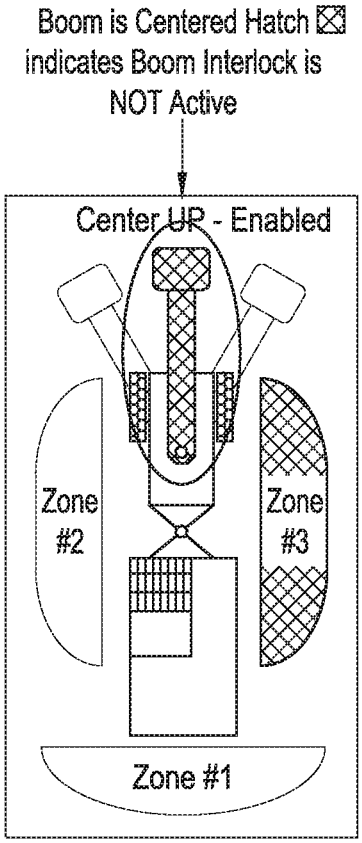
Figure 15B:
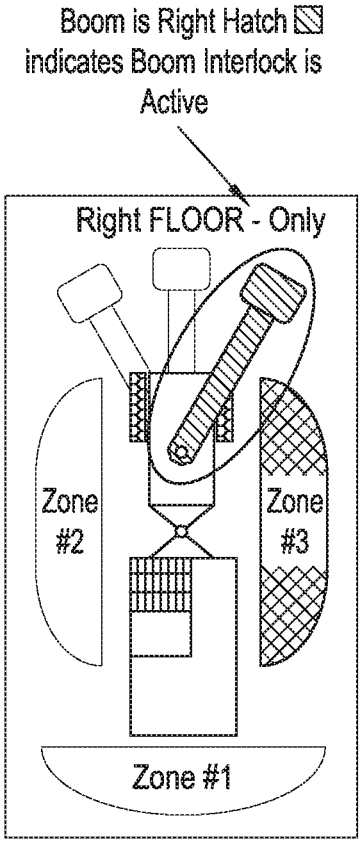

FIGS. 9, 9*a*, and 9*b* diagrammatically illustrate further aspects of the system;

FIGS. 10, 10*a*, and 10*b* are further diagrammatic illustrations of aspects of the system;

FIGS. 11, 11*a*, and 11*b* are still further diagrammatic illustrations of various aspects of the system;

FIG. 12 is a further illustration of an aspect of the system;

FIGS. 13, 13*a*, and 13*b* are still further diagrammatic illustrations of various aspects of the system;

FIGS. 14, 14*a*, and 14*b* are still further diagrammatic illustrations of various aspects of the system; and FIGS. 15, 15*a*, and 15*b* are still further diagrammatic illustrations of various aspects of the system.

Reference will now be made in detail to the present preferred embodiments of the disclosed inventions, examples of which are illustrated in the accompanying drawing figures.

DETAILED DESCRIPTION

Referring now to FIGS. 1-6, this disclosure relates to a system 10 for remotely operating a machine used in a mining operation. In one example, the machine comprises a vehicle in the form of a scaler for moving about a mine passage and using a pick for releasing material from the walls, roof, floor, etc. However, it should be appreciated that any type of vehicle used in a mine could benefit from aspects of this disclosure, including for example roof bolters, jumbo drills, haulers, scoops, lifters, or the like. In broad or general terms, the system 10 is adapted for enabling or adjusting the availability of certain functions of the associated machine or vehicle based on the detection of a controller, such as a transmitter 14, at a particular location or zone remote from the vehicle, which presence may be determined based on detecting a signal transmitted by an emitter 12 associated with the location or zone.

Using the disclosed system 10, the detection of the transmitter 14 at a particular location or zone (such as a zone 20*a* behind the machine) may be reported to a controller 16. The controller 16 may be programmed to control the functionality of the machine or vehicle, such as for example the movement of a boom 22 or other movable part to a particular location, or perhaps even movement of the machine or vehicle itself. Based on the location of the transmitter 14 at the particular zone, the controller 16 may further allow for certain functionality of the machine to be available or blocked (e.g., the machine cannot operate in a way that would interfere with the first zone, such as by allowing the movement of the boom 22 to it), but would not interfere with the operation in relation to other zones.

Figure 3:
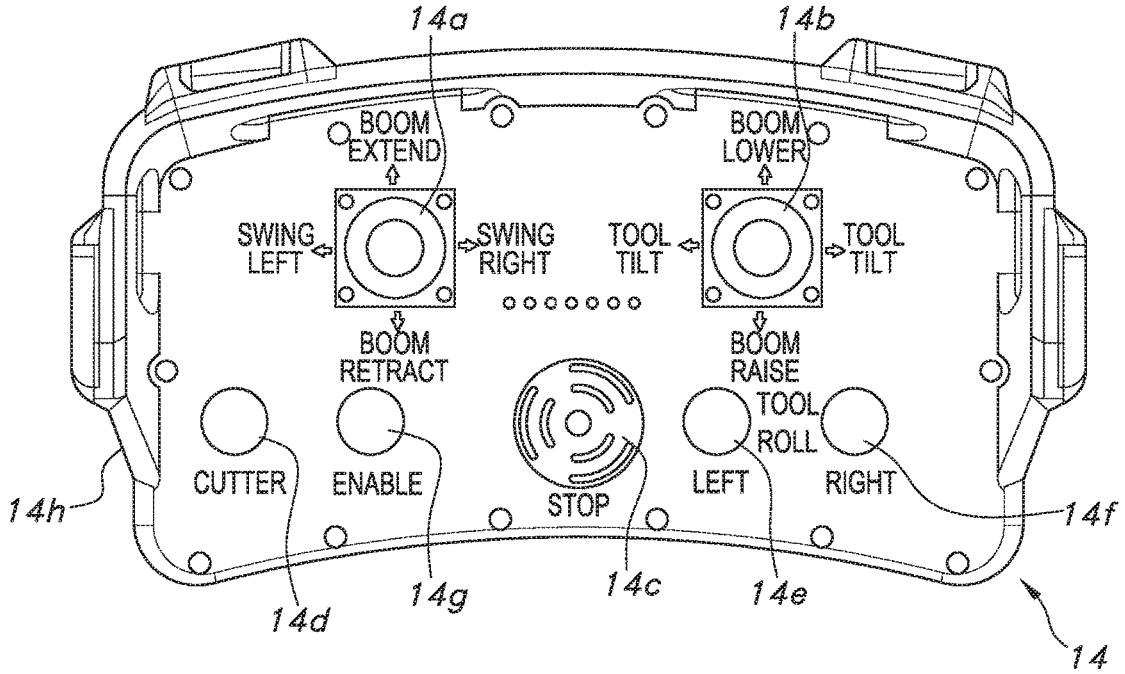
FIG. 3 is a top view of a remote transmitter.

In one possible embodiment, as shown in FIG. 3, the emitter 12 emits a particular signal indicative of a zone, such as an infrared frequency. A remote transmitter 14 is used to detect the signal from the zone emitter 12 and transmit information regarding the zone, which may be in the form of a zone number (e.g., 1, 2, 3, etc.), to a receiver 18, which receives the zone information and provides it to the controller 16. The controller 16 may then control the machine or vehicle (or, more specifically, allow remote control by the operator) in light of which functions of the mining machine are enabled.

Figure 2:
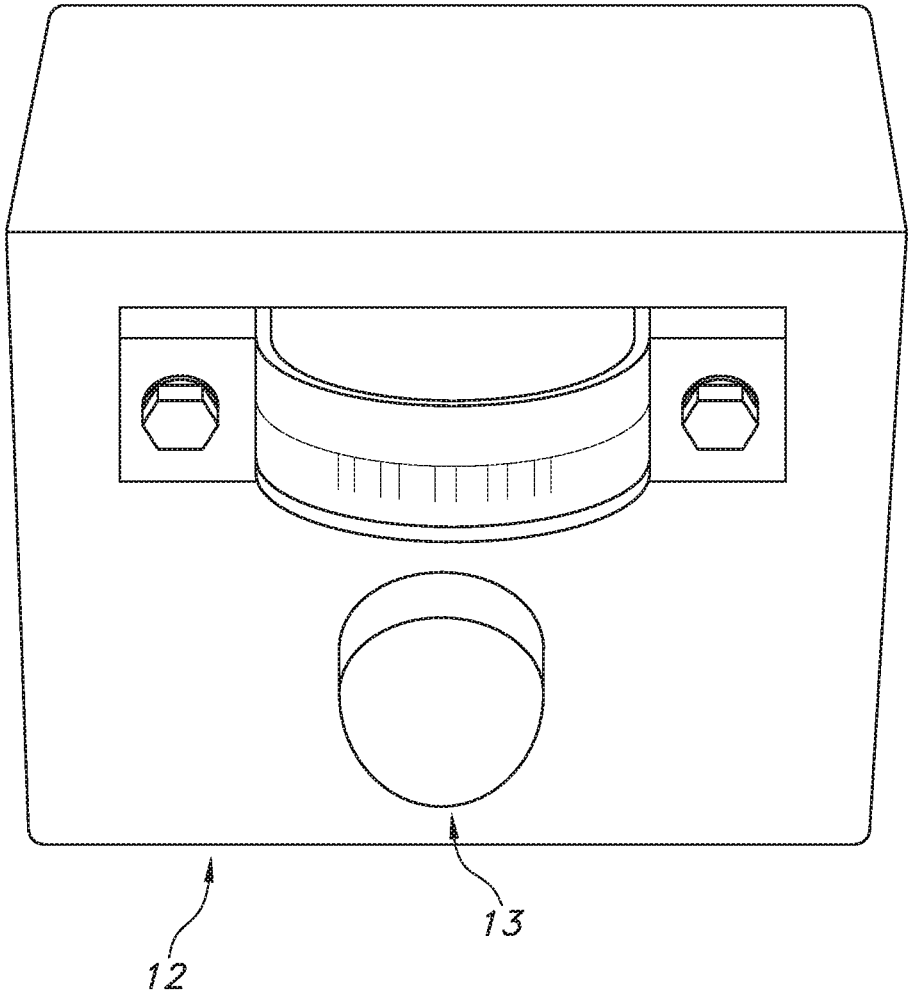
FIG. 2 is a front view of an emitter.
Figure 4:
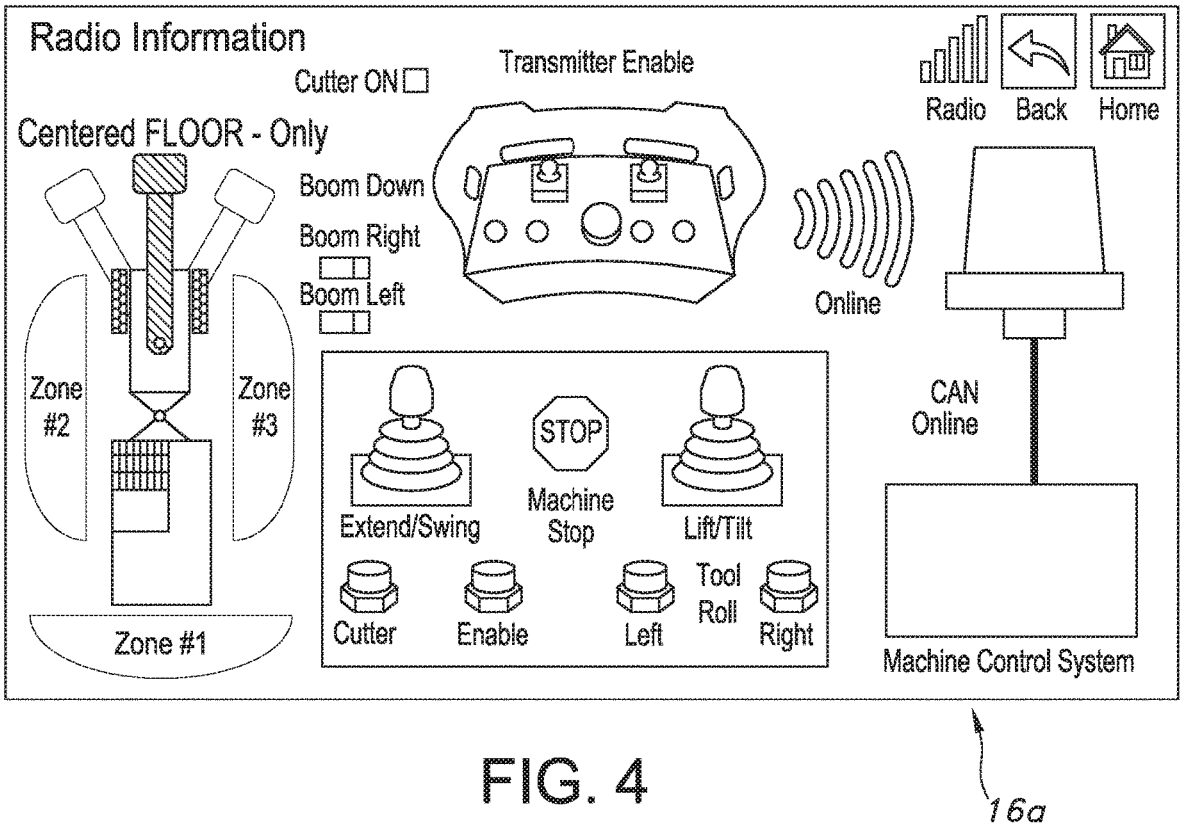
FIG. 4 illustrates a display associated with the system.

Referring now to FIGS. 2-4, examples of the emitter 12, transmitter 14, and controller 16 are shown. Referring first to FIG. 2, the zone emitter 12 may be provided with an indicator light 13. The indicator light 13 may be capable of indicating the presence of a variety of conditions, such as by providing a multi-colored light emitting diodes that can be cycled on and off. The lights may be utilized to provide feedback to the operator O on the status of the remote transmitter 14.

In one particular example, the indicator light 13 slowly flashing in a particular color, such as red, it might indicate to the operator that the remote transmitter 14 is powered on, but is not located in a particular zone. If the indicator light 13 is a solid light and/or in a different color, it might indicate that the remote transmitter 14 is located in a zone 20 and that the boom 22 operation is unlimited. If the indicator light 13 is a flashing green light, it might indicate that the remote transmitter 14 is located in a zone, but the boom 22 height is limited. If the indicator light 13 is a flashing green and red light, it might indicate a proximity sensor 28 error. If the indicator light 13 is a fast flashing green or red light, it might indicate that the remote transmitter is on, but a zone is not detected. This last scenario may result when the remote transmitter 14 is turned away from the receiver 18.

FIG. 3 illustrates one possible embodiment of the transmitter 14 for use in allowing the operator to send control signals to the controller 16 for controlling the operation of the machine. In this embodiment, the transmitter 14 comprises a hand-held portable unit, and includes various inputs, such as a boom extend, swing or retract input 14*a*, a boom lower, tilt or raise input 14*b*, a stop input 14*c* to cut off the operation of the machine. In the case of a scaler, an input 14*d* for controlling an associated pick or cutter may also be provided, along with inputs 14*e*, 14*f* for controlling the rotation of the pick or cutter. The transmitter 14 may also include an enable input 14*g*, which must be actuated prior to controlling any or all of the other inputs (and may require that all other inputs be in a neutral condition; see, e.g., U.S. Pat. No. 7,721,816, the disclosure of which is incorporated herein by reference). The enable input may also be programmed to time out if a certain amount of time passes with no input being detected. An on/off switch 14*h* may also be provided, which in the case of a vehicle can be used to activate the transmitter 14 and thus the system 10 when the operator moves from onboard the vehicle to outside of the vehicle (and vice-versa).

FIG. 4 illustrates that the machine may also include an indicator for indicating various functions to the operator. In one possible embodiment, the indicator comprises a display 16*a* associated with the controller 16. The display 16*a* may indicate various information, as indicated, including the operational status of the transmitter 14, the use of any associated inputs, and may also illustrate in real or near real time the movement of the machine and the location of the transmitter 14 in a schematic diagram.

Figure 1:
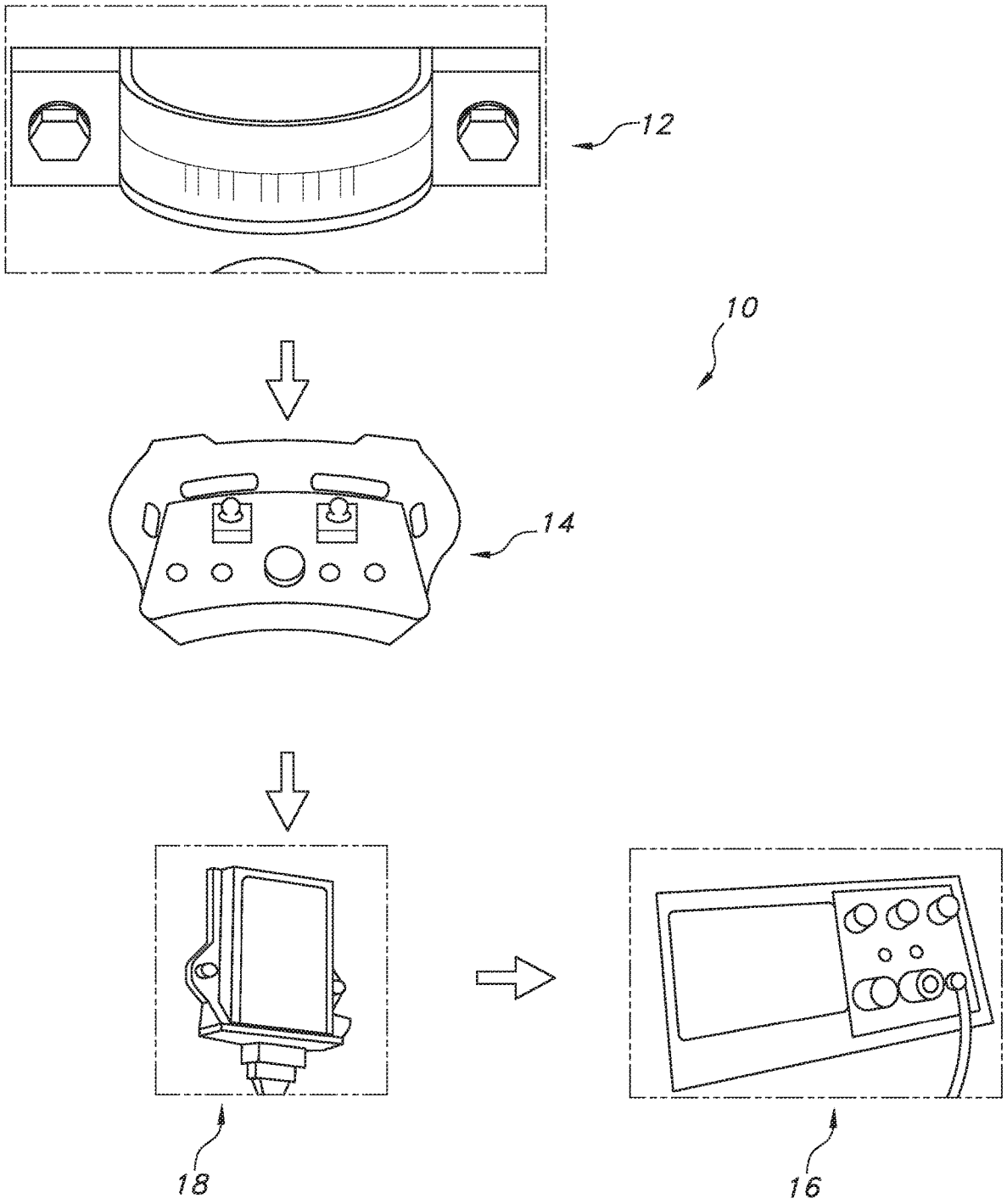
FIG. 1 is a schematic view illustrating one embodiment of the inventive system.

The display 16*a* may also allow for the control of machine or vehicle functions, or may be associated with machine or vehicle controls in a cab C or other location onboard the machine or vehicle adapted for allowing the operator to reside during normal (i.e., not remote) operation (see controller 16 in FIG. 1 and note manual inputs, which may correspond to the inputs provided on the transmitter 14). As can be appreciated, the onboard controls may also be used or viewed by an operator on the machine while a second operator outside of the machine uses transmitter 14 to control the machine functions (and the system 10 would thus provide the benefit of alerting the onboard operator to the location of the transmitter 14 remote from the machine or vehicle and/or disable functions that would cause interference with the presence of the operator with the transmitter at a particular location).

Figure 5:
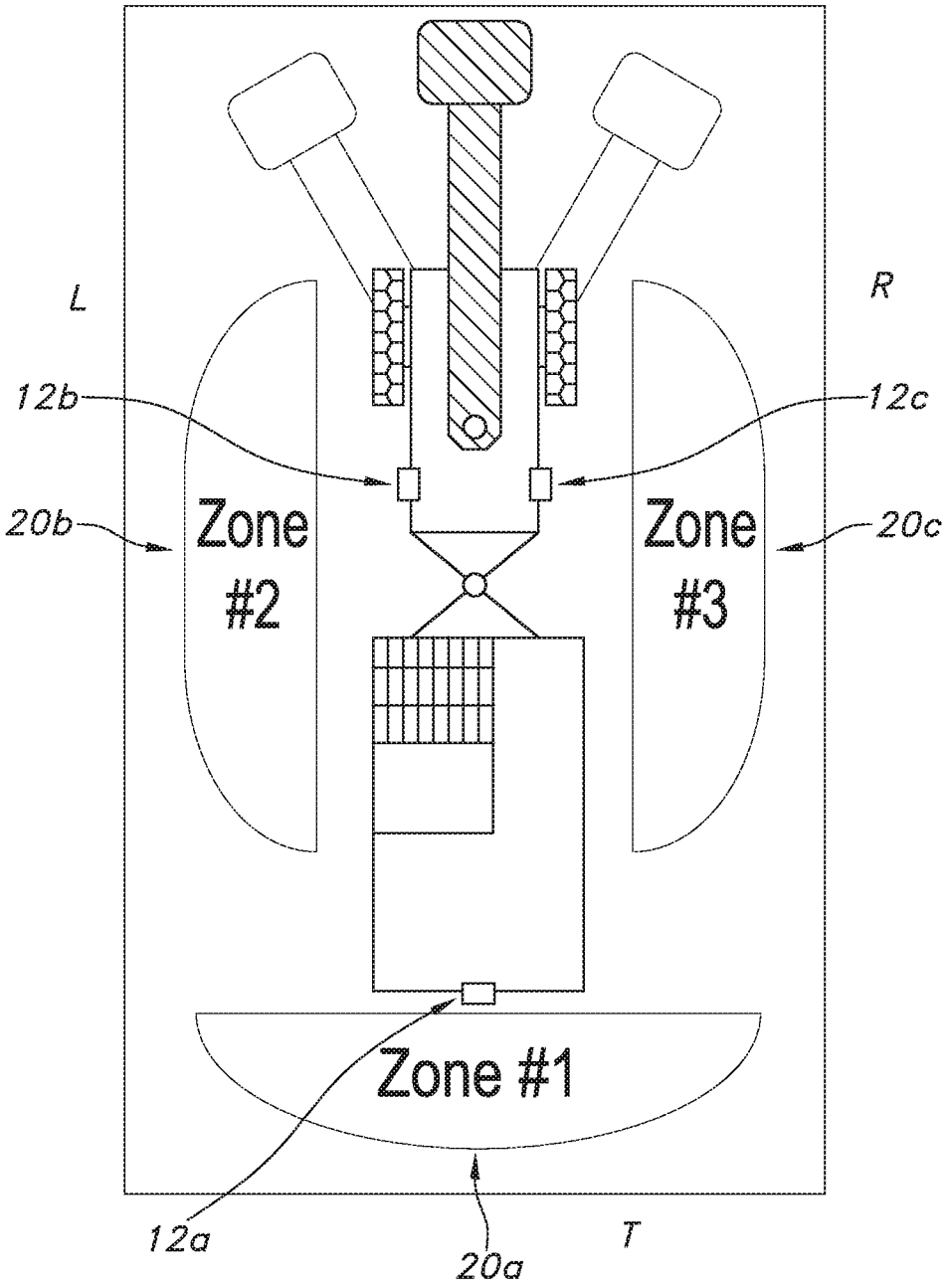
FIG. 5 is a diagram illustrating one use of the system.

Referring to FIG. 5, an embodiment of the machine is illustrated, again in the form of a scaler for scaling surfaces, such as the walls or roof of a mine passage. As can be appreciated, each emitter 12 defines a zone (such as by emitting a signal with a unique address), and a plurality of emitters can be associated with a particular machine. In the example of FIG. 5, three such emitters 12*a*, 12*b*, 12*c* are provided, each defining a zone 20*a*, 20*b*, 20*c*. Specifically, the first emitter 12*a* is associated with zone 20*a*, at the rear side T of the mining machine, opposite the boom 22, a second zone emitter 12*b* is associated with zone 20*b*, at the left L side of the mining machine, and a third zone emitter 12*c* is associated with zone 20*c*, at the right R side of the mining machine. Each emitter 12 may emits a line of sight signal in particular range, such as 180 degrees.

Figure 6:
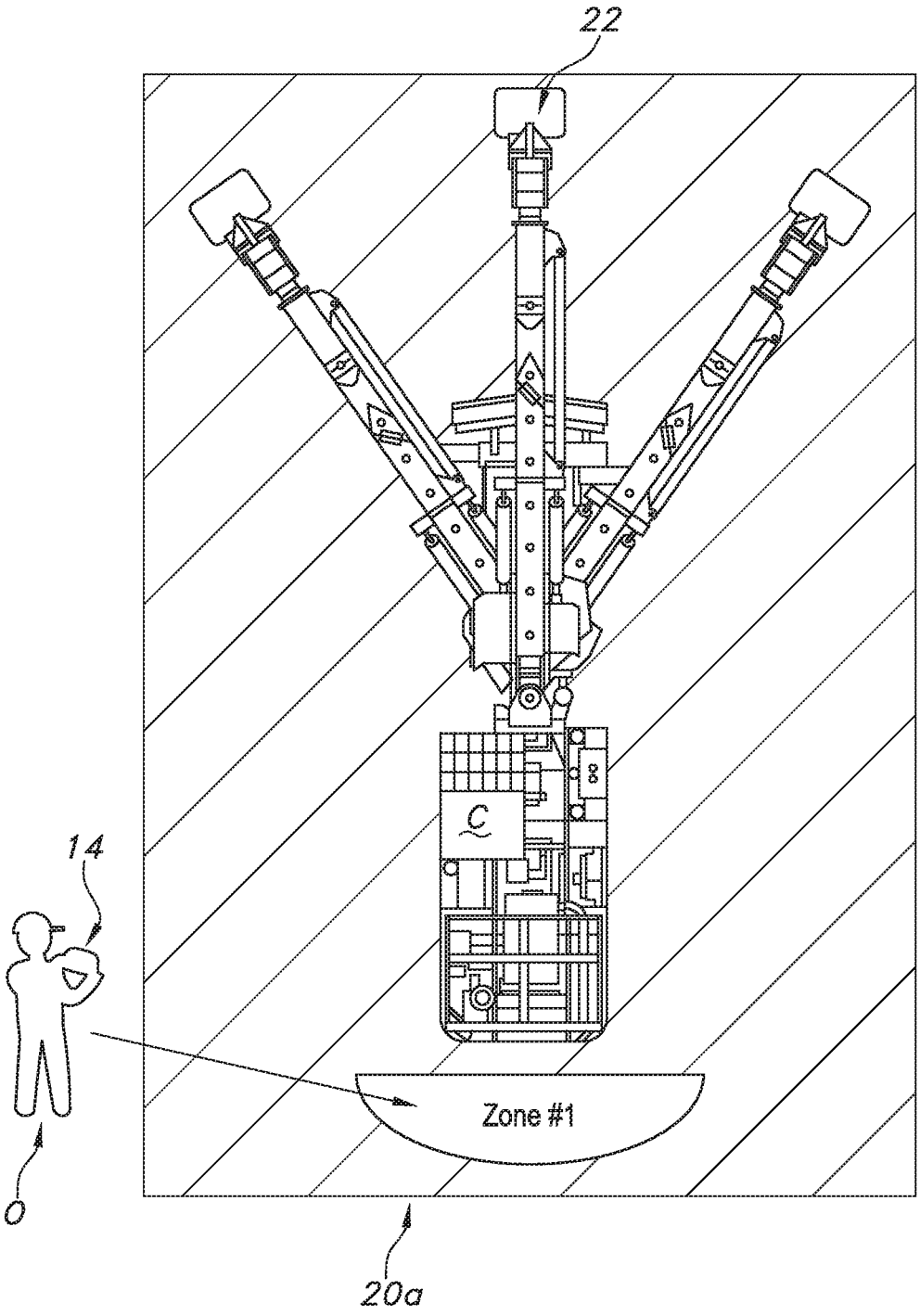
FIG. 6 is another diagram.
Figure 7:
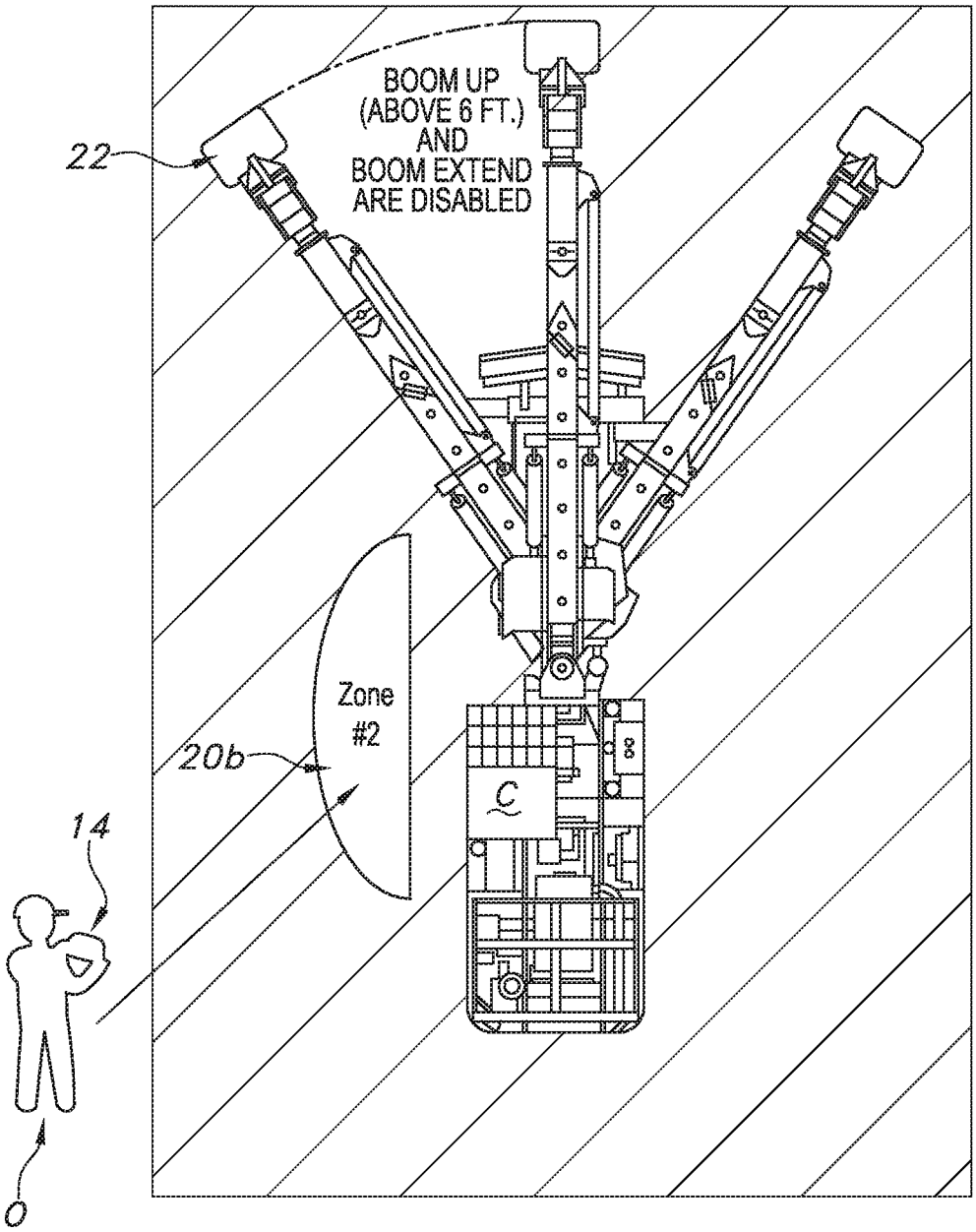
FIG. 7 is another diagram.
Figure 8:
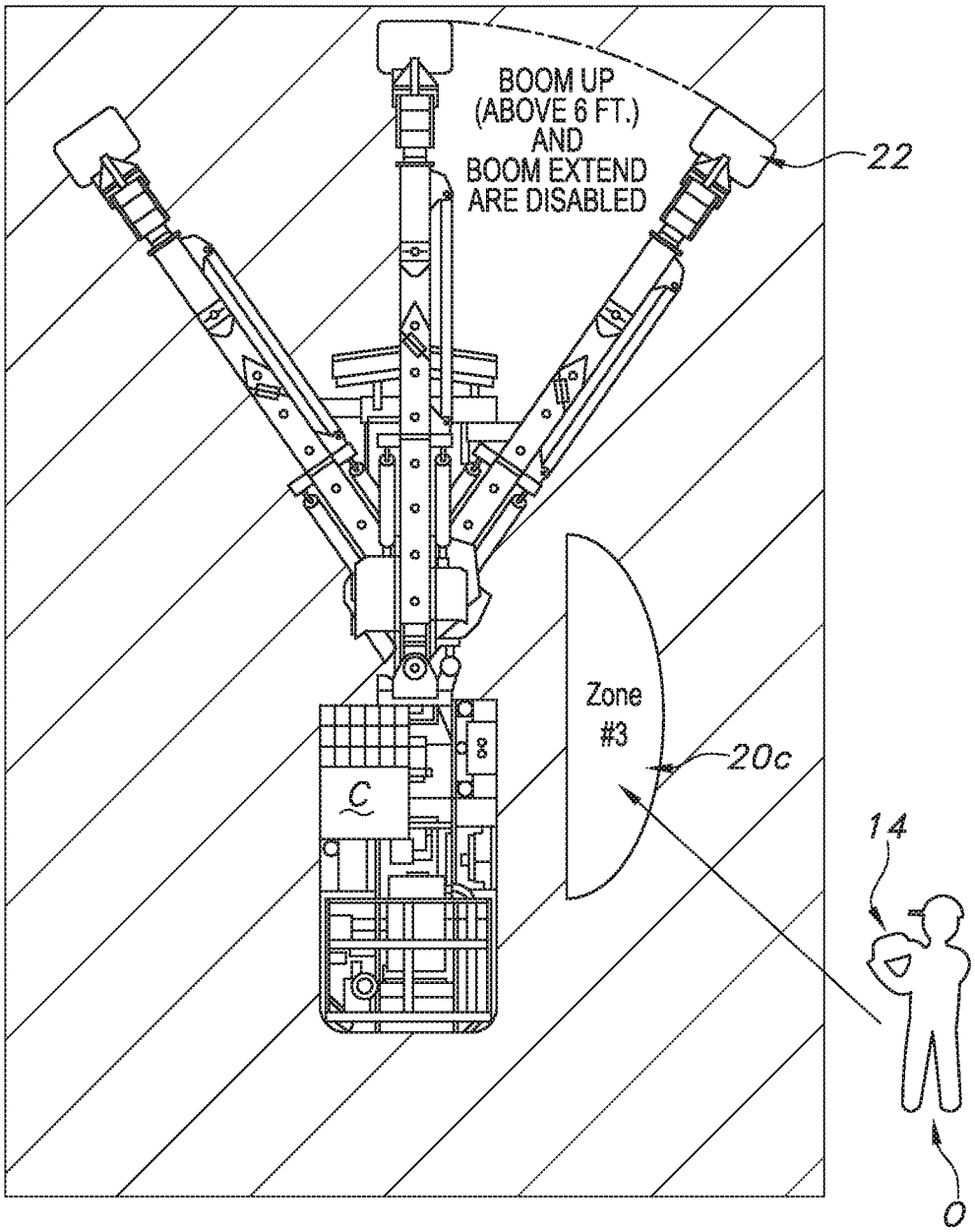
FIG. 8 is another diagram.

FIGS. 6-8 illustrate an operator O located in a first zone 20*a*. The system 10, via transmitter 14, may identify the location of the operator O to the controller 16. Based on the location of the operator O in zone 20*a*, the controller 16 may determine which functions of the machine may be available for control by the operator or, in particular, whether any restrictions on control should be implemented. Thus, for example, boom 22 travel may be unrestricted when the operator is located in zone 20*a*, which is a zone that cannot be reached by the boom (which may be considered a first control protocol, for example). Thus, the operator O may be granted full control of boom 22 and can begin unrestricted operation of the mining machine, such as scaling a mine roof and floor.

Turning to FIG. 7, the operator O may be located in zone 20*b*, which again may result in the controller 16 receiving information on the location of the transmitter 14. Accordingly, the controller 16 may limit the machine operation, such as for example by limiting the travel of the boom 22. Specifically, when the boom 22 swings to the left of center, the boom 22 will not raise, or will not raise above a particular pre-determined height (e.g., above six feet). The boom 22 is also prevented from extending while it is left of center and the operator O is in zone 20*b* (the foregoing being considered, for example, a second control protocol).

With reference to FIG. 8, the operator O is now shown as being located in zone As was the case when the operator O was located in zones 20*a* and 20*b*, the controller 16 receives information regarding the position or location of the transmitter 14 (and thus operator to the controller 16 for determining which functions are available to the operator O. Thus, as but one example, the controller 16 may restrict the operation such that the boom 22 will not raise, or will not raise a particular amount (e.g., above six feet) when the boom 22 is right of center and the operator is in zone 20*c*. Boom 22 extension may also be disabled.

As noted above, the controller 16 may also include an indicator, such as the display 16*a*. FIGS. 9, 9*a* and 9*b* illustrate that the controller 16 will indicate which zone of the exemplary three zones 20*a*, 20*b*, 20*c* is active. FIGS. 10, 10*a*, and 10*b* further illustrate that the display 10*a* may indicate the movement of the boom to positions (e.g., 22*a*, 22*b*, 22*c*), which may correspond at least partially to the zones. The ability to visualize the movement on the display 16*a* associated with the controller 16 (or on transmitter 14) may be especially helpful when installing or troubleshooting the system 10.

With reference to FIGS. 11, 11*a*, and 11*b*, the display 16*a* may also be configured to indicate which functions of the boom 22 are disabled or limited, including when a zone 20 is not detected (that is, the transmitter 14 is not detected as being located in any zone). As can be seen, the representation of the boom 22 provided on the display 16*a* may be highlighted in a particular color, such as gray, when functions such as swing left/right or lift are disabled or limited. With reference to FIG. 11, no zone 20 is detected, and the boom 22 is depicted as being located to the left of center. The boom 22 in this embodiment is disabled from being raised and from swinging left. In the embodiment illustrated by FIG. 11*a*, the boom 22 is limited from being raised when no zone 20 is detected and the boom is centered. In the embodiment illustrated by FIG. 11*b*, the boom 22 is disabled from being raised and from swinging to the right. As can be understood, the boom movement is not limited when being operated from the operator's cab.

In order to display the conditions, it can be appreciated that detection of the movements of the machine may also be achieved using sensors. With reference to FIGS. 12 and 12*a*, proximity sensors 28 may be used to detect the boom movement, such as for example the boom height, but could also be used to sense left and right movement.

FIGS. 13-15 illustrate further examples of the restrictions on the travel of boom 22 based on which zone 20 is active. For instance, FIGS. 13, 13*a*, and 13*b* illustrate how the display 16*a* may indicate the operation of the machine, such as movement of the boom 22, when the transmitter 14 is at a particular location, such as a first zone at the rear of the vehicle. FIGS. 14, 14*a*, and 14*b* provide a similar illustration with the transmitter 14 in a second zone, and FIGS. 15, 15*a*, and 15*b* show the display 16*a* when the transmitter is in a third zone.

The foregoing descriptions of various embodiments are provided for purposes of illustration, and are not intended to be exhaustive or limiting. Modifications or variations are also possible in light of the above teachings. For instance, while disabling a boom is described, it should be appreciated that any feature of the machine could be disabled as a result of the zone detection concept. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. A system for remotely operating a machine, comprising:

a first emitter for emitting a first signal corresponding to a first zone adjacent to the machine;

a transmitter for receiving the first signal emitted by the first emitter, the transmitter being adapted for issuing commands for controlling the machine and also indicating the presence of the transmitter in the first zone;

a controller for controlling the machine based on control signals from the transmitter based on the presence of the transmitter in the first zone; and a second emitter for emitting a second signal corresponding to a second zone adjacent to the machine;

wherein the controller is adapted for limiting movement of a part movably attached to the machine from a first set of available movements to a smaller subset of said available movements when the transmitter is present within the first zone.

2. The system of claim 1, wherein the controller is adapted for preventing any part of the machine from moving to the first zone when the transmitter is indicated therein.

3. The system of claim 1, further including a receiver for receiving the commands from the transmitter and providing the commands to the controller.

4. The system of claim 1, further including an indicator for indicating the presence of the transmitter in the first zone.

5. The system of claim 1, wherein the transmitter includes one or more inputs for controlling the machine.

6. The system of claim 5, wherein the transmitter comprises a hand-held, portable unit.

7. The system of claim 1, wherein the controller is adapted for allowing the machine to operate in any zone other than the first zone.

8. The system of claim 1, wherein the part of the machine comprises a boom.

9. A method of controlling a machine, comprising:

detecting the presence of a transmitter for transmitting commands for controlling the machine in a particular zone; and enabling the machine to operate in a predetermined manner based on the detected presence of the transmitter in the particular zone, wherein a signal indicative of the particular zone is emitted by the machine;

wherein the enabling step comprises allowing a part movably attached to the machine to move within a different zone when the transmitter is present in the particular zone;

wherein the enabling step comprises preventing the part of the machine movably attached to the machine from moving to or within the particular zone when the transmitter is present therein.

10. The method of claim 9, further including controlling the machine using controls onboard the machine or controls associated with the transmitter.

11. A system for remotely operating a machine, comprising:

a first emitter for emitting a first signal corresponding to a first zone adjacent to the machine;

a transmitter for receiving the first signal emitted by the first emitter, the transmitter being adapted for issuing commands for controlling the machine and also indicating the presence of the transmitter in the first zone;

a controller for controlling the machine based on control signals from the transmitter based on the presence of the transmitter in the first zone; and a second emitter for emitting a second signal corresponding to a second zone adjacent to the machine;

wherein the controller is adapted for preventing any part of the machine from moving to the first zone when the transmitter is indicated therein.

12. A method of controlling a machine, comprising:

detecting the presence of a transmitter for transmitting commands for controlling the machine in a particular zone; and enabling the machine to operate in a predetermined manner based on the detected presence of the transmitter in the particular zone, wherein a signal indicative of the particular zone is emitted by the machine;

wherein the enabling step comprises allowing the machine to move within a different zone when the transmitter is present in the particular zone;

wherein the enabling step comprises preventing the machine from moving to the particular zone when the transmitter is present therein.

13. A system for remotely operating a machine, comprising:

a first emitter for emitting a first signal corresponding to a first zone adjacent to the machine;

a transmitter for receiving the first signal emitted by the first emitter, the transmitter being adapted for issuing commands for controlling the machine and also indicating the presence of the transmitter in the first zone;

a controller for controlling the machine based on control signals from the transmitter based on the presence of the transmitter in the first zone; and a second emitter for emitting a second signal corresponding to a second zone adjacent to the machine;

wherein the controller is adapted for preventing a part movably attached to the machine from moving to or within the first zone when the transmitter is present in the first zone, and to allow said part to move outside the first zone.

14. The system of claim 13, wherein the movable part comprises a boom.

* * * * *